US008980012B2

(12) United States Patent
Fuller

(10) Patent No.: US 8,980,012 B2
(45) Date of Patent: Mar. 17, 2015

(54) APPARATUS AND METHOD FOR DE-INKING PRINTED SURFACES

(76) Inventor: Ron Fuller, Overland Park, KS (US)

( * ) Notice: Subject to any disclaimer, the term of this patent is extended or adjusted under 35 U.S.C. 154(b) by 0 days.

(21) Appl. No.: 13/462,387

(22) Filed: May 2, 2012

(65) Prior Publication Data

US 2012/0279524 A1 Nov. 8, 2012

Related U.S. Application Data

(60) Provisional application No. 61/482,096, filed on May 3, 2011.

(51) Int. Cl.
*B08B 9/28* (2006.01)
*B08B 1/00* (2006.01)
*B08B 3/08* (2006.01)

(52) U.S. Cl.
CPC .... *B08B 1/00* (2013.01); *B08B 3/08* (2013.01)
USPC ..... 134/26; 134/94.1

(58) Field of Classification Search
CPC ..... B08B 3/08; B08B 1/00; B08B 9/08; B08B 9/20; B08B 9/087; C09D 9/00; C09D 9/005
USPC ..... 134/10, 26
See application file for complete search history.

(56) References Cited

U.S. PATENT DOCUMENTS 3,956,791 A * 5/1976 Rutten ..... 15/302
3,960,073 A * 6/1976 Rush ..... 101/40
5,672,231 A * 9/1997 Willkens et al. ..... 156/709
5,694,657 A 12/1997 Yoshida et al.
5,830,836 A 11/1998 Smith et al.
6,147,041 A * 11/2000 Takahashi et al. ..... 510/174
6,231,678 B1 * 5/2001 Arruda et al. ..... 134/3
6,262,133 B1 * 7/2001 Wisner ..... 521/40
6,284,720 B1 9/2001 Opre
6,569,256 B1 5/2003 Koizumi
6,803,085 B2 * 10/2004 Blom et al. ..... 428/42.1
7,416,612 B1 * 8/2008 Montie ..... 134/38
2010/0212687 A1 * 8/2010 De Souza ..... 134/2
2010/0273695 A1 * 10/2010 Sehgal et al. ..... 510/174
2011/0088730 A1 * 4/2011 De Souza ..... 134/32

FOREIGN PATENT DOCUMENTS

JP 09057226 A * 3/1997 ..... B08B 11/00

OTHER PUBLICATIONS

International Search Report and Written Opinion for PCT/US2012/036142, dated Nov. 14, 2012, 9 pages.

* cited by examiner

*Primary Examiner* — Michael Kornakov
*Assistant Examiner* — Katelyn Whatley
(74) *Attorney, Agent, or Firm* — Hovey Williams LLP

(57) ABSTRACT

Apparatus and method for removing an ink image from a plastic substrate, particularly a plastic container such as a cup, are provided. A solvent capable of solvating the ink image is utilized in order to de-ink articles so that they can be recycled and re-imprinted thereby reducing waste associated with printing line start up. As the articles may be intended for use with food and beverage products, a safe and non-toxic solvent may be selected. However, to ensure that the article is not contaminated with foreign materials prior to human use, the de-inked article may undergo a rinse and drying operation to remove solvent residues and UV light treatment to eliminate any harmful microorganisms that may be present on the article's surfaces.

8 Claims, 5 Drawing Sheets

APPARATUS AND METHOD FOR DE-INKING PRINTED SURFACES

RELATED APPLICATION

This application claims the benefit of U.S. Provisional Patent Application No. 61/482,096, filed May 3, 2011, which is incorporated by reference herein in its entirety.

BACKGROUND OF THE INVENTION

1. Field of the Invention

The present invention is directed toward a process and apparatus for removing ink from plastic materials, such as plastic films and food and beverage containers. In certain embodiments, the ink to be removed has been applied to the plastic material by dry offset printing, although other types of ink and printing processes may also be used.

2. Description of the Prior Art

The startup of a dry offset printing line, including the change-over from printing one type of image to another, is generally considered an art form as it involves a number of manual adjustments to the line including the positioning of the various plates and color usage. Further, it is not uncommon for any printing operation to produce misprinted items or have over-runs in terms of quantities of products printed. These operations typically result in the creation of 4-7% scrap product (based upon the total product to be printed). The scrap plastic is traditionally ground up and resold for non-food and beverage applications. As the cost of raw materials, particularly plastics, continues to rise, the production of high levels of scrap material can prove quite costly.

U.S. Pat. No. 5,830,836 is directed toward compositions and methods for removal of polymeric coatings, such as paint, enamel, lacquer, varnish, a sealant, or the like, from non-porous surfaces, such as metal, certain stone, acrylic siding, and may be the surface of an aircraft, a car, or a building. Particularly, a peroxide-based solution having a pH of about 6.5 to 11.0 is used. This solution may also comprise a surfactant such as between 1-5% by weight of a linear alkyl ethoxylate, and significant quantities of benzyl alcohol and various glycols. The solution is preferably mixed up just prior to use and remains useful for only about 24 hours.

U.S. Pat. No. 6,147,041 is directed toward a removable ink composition and a process for removing the ink from printed articles. The ink removal process generally comprises applying a 1-3% solution of sodium hydroxide at a temperature of 80-90° C. onto a plastic bottle, for example, containing an image printed thereupon. The solution is then permitted to contact the plastic substrate for 20-30 minutes.

U.S. Pat. No. 6,663,929 is directed toward removing ink from labels, made from a heat-shrinkable polymer film, by contacting the film with a hot alkaline solution (3% sodium hydroxide, at 90-95° C. for 30 minutes.

U.S. Pat. No. 6,803,085 is directed toward a method of removing an "ink-only" label from a plastic substrate without destructive treatment of the substrate. The label is removed by exposing the label and substrate to a pre-rinse solution comprising 1-5% sodium hydroxide at 60° C. Next, the substrate is soaked in a similar sodium hydroxide-based solution for between 40-110 seconds wherein the labels are completely removed. The substrate is then rinsed with 30° C. water.

U.S. Pat. No. 7,416,612 is directed toward a process for removing paint from a plastic substrate so that the substrate can be repainted for reuse. The process involves immersing the coated plastic substrate into a first aqueous fluid that contains benzyl alcohol, glycolic acid, sodium lauryl sulphate, 2-mercaptobenzothiazole, and xylene, and has a temperature of 140-180° F. After this immersion step, the plastic can either be rinsed off and reused, or it can be immersed in a second fluid comprising a blend of biodegradable, non-regulated solvents and emulsifiers, such as ethylene glycol, monoethyl or diethyl ether, and a dibasic ester.

As can be seen, a number of these references utilize caustic or hazardous compounds. Further, a number of the processes described the above references are quite time consuming. Accordingly, there is a need to develop a quick, safe, and bio-friendly way to de-ink plastic articles so that they may be reused. The present invention seeks to avoid use of hazardous chemicals by providing a method of de-inking plastic articles using a safe and bio-friendly solvent. Additionally, the present invention provides an apparatus that can de-ink plastic articles in a timely, efficient, and automated manner.

SUMMARY OF THE INVENTION

The present invention provides a method of removing the ink from synthetic resin material surfaces, such as the surfaces of thin or flexible films or the surfaces of containers formed from synthetic resin materials, such as plastics, thereby allowing the synthetic resin material to be passed through a printing line again and eliminating the production of scrap material that often accompanies printing line start up. In certain embodiments, the process involves three primary steps. First, a solvent is applied to the synthetic resin material in order to solvate the ink printed thereon while the synthetic resin material is scrubbed to aid in the removal of the ink. Next, the synthetic resin material is sent through a water wash cycle to remove ink and solvent residues. Finally, the synthetic resin material is dried. The synthetic resin material emerges from this process ready for re-printing.

The present invention also provides an apparatus for removing ink from synthetic resin materials. In certain embodiments, the apparatus includes a loading station that loads a synthetic resin material having an ink printed thereon onto the apparatus; a solvent application station that applies organic solvent to the synthetic resin material, where the organic solvent is capable of solvating the ink image; a rinsing station that applies water to the synthetic resin material to remove the solvent residues therefrom; a drying station that removes water from the synthetic resin material; and an unloading station that off loads the de-inked containers from the apparatus.

DETAILED DESCRIPTION OF THE PREFERRED EMBODIMENT

Figure 1:
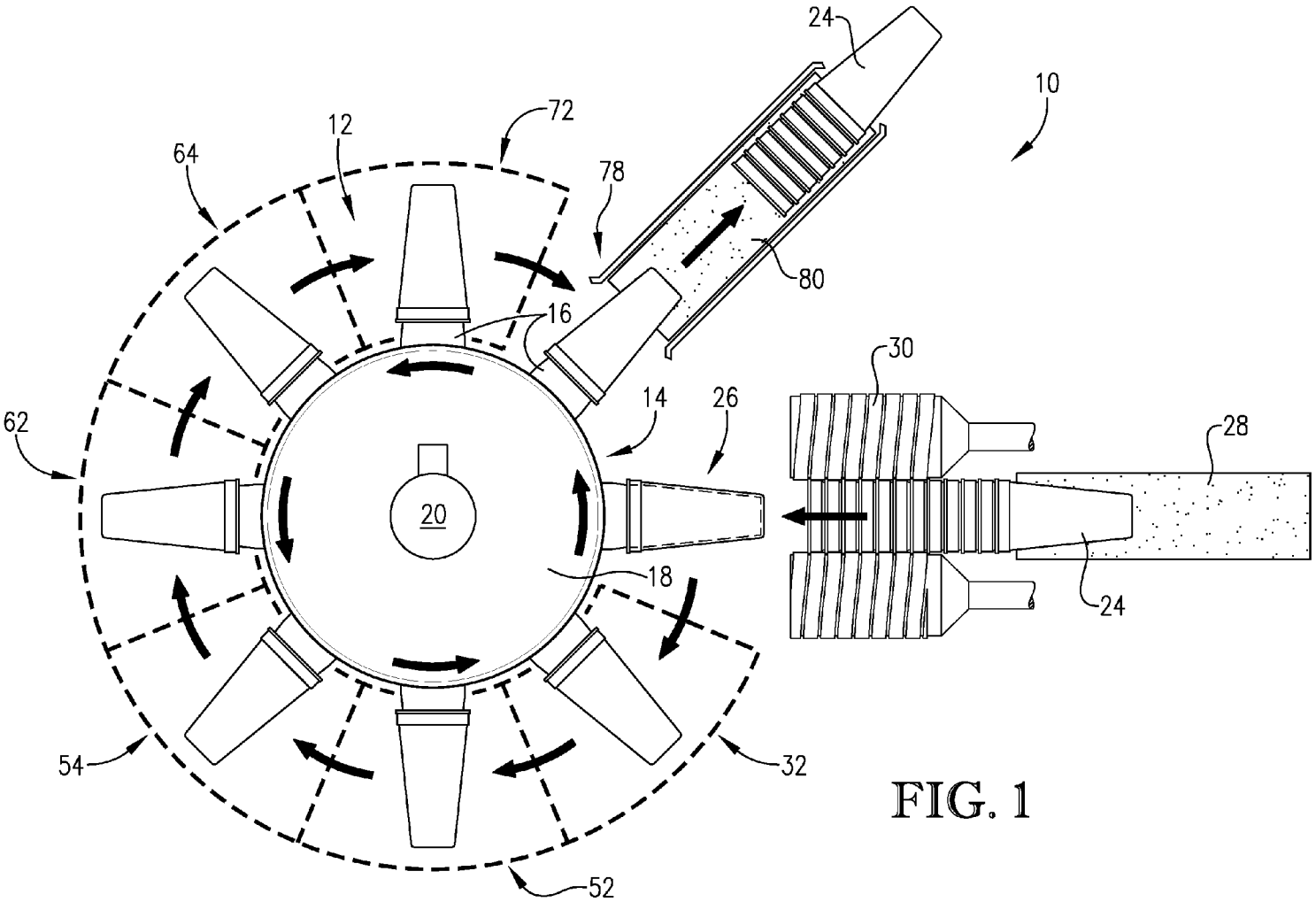
FIG. 1 is a schematic diagram of an exemplary de-inking apparatus according to the present invention.

The present invention provides methods and apparatus for removing ink from synthetic resin material surfaces, particularly ink printed upon a container surface, such as a cup, which will be used to illustrate the principles of the present invention. Although, it is within the scope of the invention for the methods and apparatus described herein to be adapted for use on other types of printed surfaces such as on synthetic resin material webs, sheets, and films, such as banner material and lids. Therefore, the following discussion should be taken as illustrative and not as limiting the scope of the present invention in any way. In certain embodiments, an ink image is printed upon the outer surface of a substantially cylindrical or frustoconical container. The container is formed from a synthetic resin material such as a polyolefin (e.g., polyethylene or polypropylene), biopolymers (e.g., plant-based materials including starch-containing plastics), or polyesters (e.g., polyethylene terephthalate). The container outer surface, particularly at least that portion containing the printed image, is generally smooth and non-porous. In certain embodiments, this aspect excludes containers created from highly porous materials such as polystyrene as the ink, when printed thereupon, penetrates into the material's pores.

The ink image can be applied to the synthetic resin material surface through any number of recognized means, such as screen printing or dry offset printing. The inks can be any ink suitable for use in these printing methods, including UV-curable inks. As noted above, the start up of a printing line in order to print a certain image onto the outer surface of a container is not an exact science and involves a fair amount of trial and error in order to pin point the precise printing parameters needed to produce an acceptable product. This trial and error process generates large quantities of printed products whose printed images are not of a quality suitable for delivery to a customer. The present invention allows for the inferior images on these products to be removed and the containers to be recycled back through the printing line thereby substantially eliminating much of the waste associated with printing start up.

In one embodiment of the present invention, a solvent is applied to the outer surface of the container containing the ink image. The solvent is capable of solvating the ink which has been cured upon the container surface. Therefore, the solvent must be capable of weakening the adherence of the ink to the container surface. The solvent may be applied by dipping the container in the solvent, spraying the solvent onto the container, or wiping the container surface with a solvent-laden textile material. It is important that the particular method of solvent application not scratch or de-gloss the container itself thereby rendering the container unsuitable for reuse. The solvent selected may be any solvent capable of de-adhering the ink from the surface of the container on which it is printed. However, the ink image should be un-varnished, that is, there should be no varnish or clear coat applied on top of the ink image. In certain embodiments, particularly those applications wherein the plastic material is to be used on food and beverage containers, the solvent is a non-toxic, environmentally friendly material. Although, the requirement for a non-toxic solvent may be lessened when the target substrate is not going to be used for this purpose. In particular embodiments, the solvent comprises an organic solvent that is non-corrosive, non-flammable, and does not contain any EPA Hazardous Air Pollutants. Exemplary solvents that may be used in with methods according to the present invention include those selected from various classes of chemicals such as esters (e.g., alkyl esters), ketones, glycols, glycol ethers, halogenated solvents, aromatics, alcohols, aliphatic hydrocarbons, amines, and terpenes. More specifically, the solvent is selected from the group consisting of amyl propionate, butyl butyrate, alkyl lactates, ethyl hexyl acetate, dibasic esters, methyl soyate, ethyl soyate, cyclohexanone, methyl ethyl ketone, dipropylene glycol, dipropylene glycol methyl ether, diethylene glycol butyl ether (DGBE), trichloroethylene, xylene, ethanol, 2-propanol, tetrahydrofurfuryl alcohol, hexane, mineral spirits, monoethanolamine, d-limonene, dimethyl formamide, n-methyl pyrrolidone, propylene carbonate, and combinations thereof. In still another embodiment, the solvent is an alkyl ester solvent having the general formula RCOOR', wherein R and R' are independently selected from C1-C10 alkyl groups and R contains at least one hydroxyl group. One particular solvent that has been found to produce acceptable results is Substi-Solve, available from Flexocleaners.com, Bellport, N.Y.

The solvent may also comprise a surfactant to assist in the de-inking process. Any surfactant capable of aiding in the removal of the ink can be used, including anionic, cationic, nonionic, zwitterionic, amphoteric, and ampholytic surfactants. Exemplary anionic surfactants comprise various sulfate, sulfonate, and carboxylate compounds. Exemplary amphoteric surfactants comprise amine oxides. Exemplary zwitterionic surfactants comprise derivatives of secondary and tertiary amines, such as betaine compounds. Exemplary cationic surfactants comprise alkoxylated amines. Exemplary nonionic surfactants comprise alcohol alkoxylates. In one embodiment, the nonionic surfactant comprises from about 0 to about 9% of C9-C11 alcohol alkoxylates. In a preferred embodiment, the nonionic surfactant comprises from about 0 to about 9% of C9-C11 alcohol ethoxylates.

In one embodiment, solvent application is carried out using a mechanical scrubbing device. The mechanical scrubbing device may comprise a textile material, such as wool or cotton felt, onto which the solvent is directly applied. Then, the textile material, which may be in the form of a movable belt or roller, is brought into contact with the container and the image is effectively "scrubbed" from the outer surface of the container. During this scrubbing operation, at least some of the ink is transferred from the container to the scrubbing device. However, particles of ink may remain loosely adhered to the container as a result of surface tension interactions between the particles and the container. These particles, along with any solvent residues are removed in subsequent processing steps described below.

Although not required, to aid in the ink removal, the container, and particularly the surface of the container bearing the image may be heated. In certain embodiments, the container is heated to a temperature of between about 100° to about 185° F., or between about 110° to about 175° F., or between about 130° to about 170° F. The heating can be accomplished by a variety of means. In one embodiment the heating involves directing heated air onto the outer surface of the container.

Next, the solvent, and any ink residues, are rinsed from the surface of the container. Any rinsing process capable of removing the solvent and ink residues from the container can be used. For example, the rinsing step may employ application of water to the container surface by methods similar to those used to apply the solvent. Alternatively, the rinsing step may employ other methods than those used to apply solvent to the container, such as contacting the container with a water-laden sponge, or spraying water directly onto the container.

Following the rinsing step, the containers can be dried by any number of means, such as application of heated air, buffing with a dry cloth or sponge, or a combination thereof. The containers may also be sanitized at this stage, such as through application of UV light, in order to kill bacteria present on the containers.

The present invention may also be used to de-ink post-consumer synthetic resin articles. For example, synthetic resin material containers that have been used by consumers can be de-inked, reprinted, and recycled for further consumer use. In such embodiments, the interior or non-printed surfaces of the containers will need to be cleaned as a part of the overall recycling process.

Figure 2:
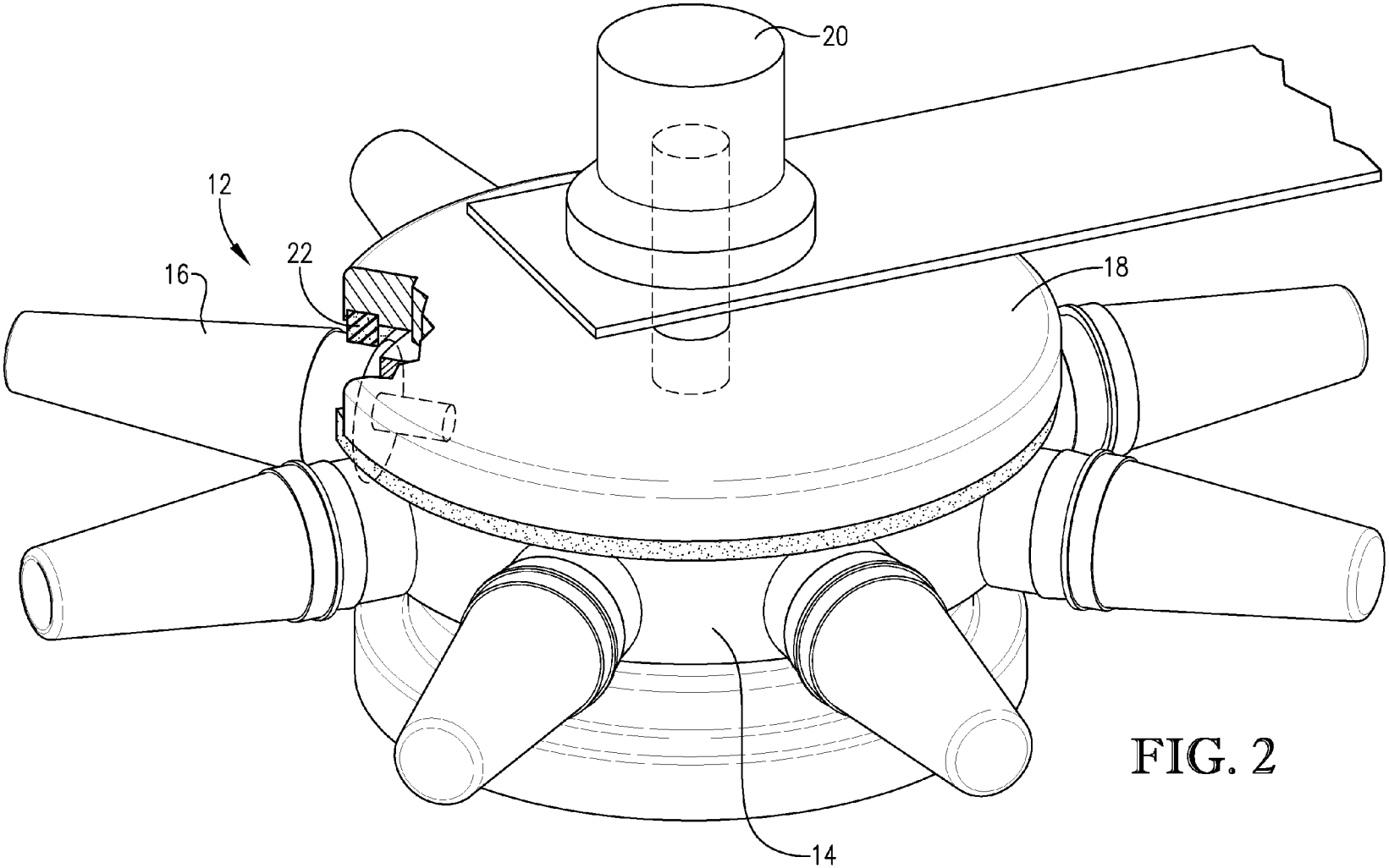
FIG. 2 is a perspective view of a container-handling device according to one embodiment of the present invention.

The following description illustrates an exemplary de-inking system according to one embodiment of the present invention. It is to be understood, however, that this embodiment is illustrative of the principles of the present invention and should not be taken as limiting the overall scope thereof. Turning first to FIG. 1, a de-inking apparatus 10 is shown comprising a rotatable container-handling device 12. Device 12 comprises a rotatable hub 14 having a plurality of mandrels 16 disposed thereon. An alternate view of device 12 is depicted in FIG. 2. As explained further below, rotation of hub 14 serves to advance the container to be de-inked through a plurality of stations where the container is subjected to a particular operation. Other configurations to advance a synthetic resin material container through a plurality of stations are also within the scope of this invention, even though not depicted in the Figures. For example, in certain embodiments, apparatus 10 may be configured to advance a container through a plurality of stations arranged in a substantially linear manner, as opposed to the illustrated circular manner.

Device 12 further comprises a rotatable disk 18 that is operably coupled to a motor 20. Motor 20 and rotates disk 18 about a first axis (shown in FIG. 1 as counter-clockwise in direction). Disk 18 provides motive force for causing each of mandrels 16 to rotate about a second axis disposed at approximately 90° (i.e., perpendicularly) from the first axis. Rotational force from disk 18 is transmitted to mandrels 16 by a friction material 22 such as a rubber material, particularly neoprene rubber.

Returning now to FIG. 1, cups 24 are fed to a loading station 26 by a conveyor assembly 28. Conveyor assembly 28 comprises three flighted screws 30 arranged in a triangular configuration. Note, one of screws 30 is disposed beneath the stack of cups 24 and is not visible in FIG. 1. To load a cup 24 onto a mandrel 16, the screws 30 are advanced and a cup is ejected onto mandrel 16. Mandrels 16 may be equipped with suction to secure cups 24 thereto as hub 14 rotates between a plurality of stations. In addition to supporting the interior surface of the cup, mandrel 16 also prevents the inside of cup 24 from coming into contact with the solvent and rinse fluids that will be used during the de-inking process. Thus, contamination of these surfaces due to the de-inking process is avoided, as is the necessity to cleanse the interior of the cups prior to reprinting.

Figure 3:
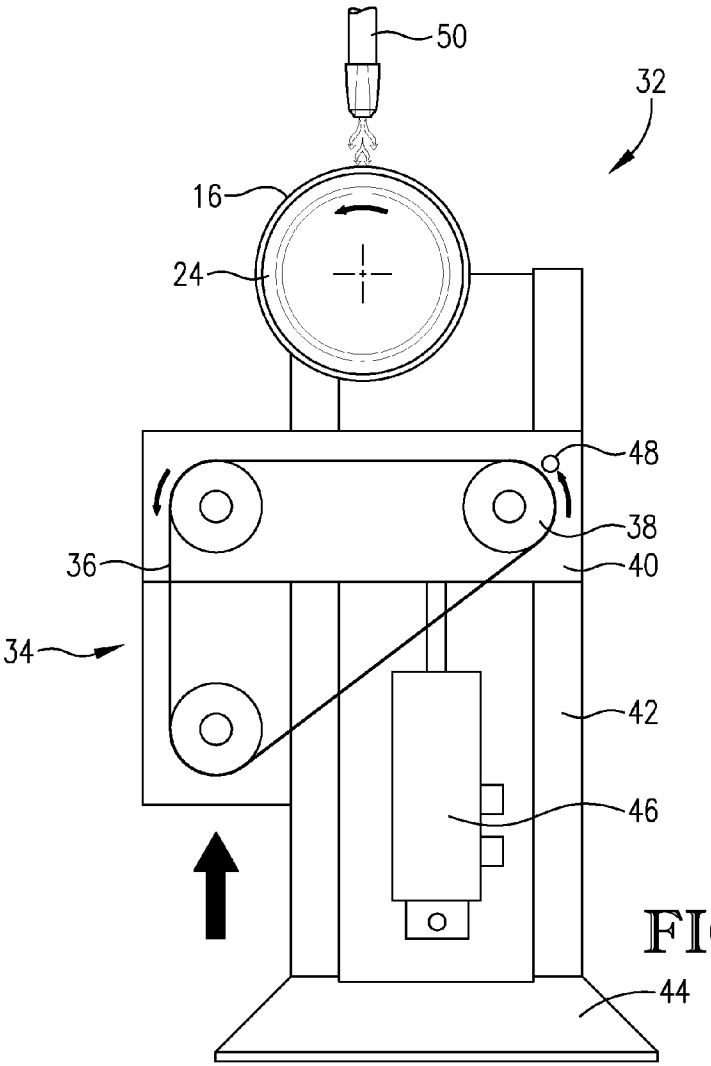
FIG. 3 is a diagram of a solvent application station for use with an apparatus according to the present invention.

Once a cup 24 has been loaded onto a mandrel 16, hub 14 rotates (in a clockwise manner as depicted in the FIG. 1) to a solvent application station where solvent is applied to cup 24. FIG. 3 illustrates an exemplary solvent application station 32. Solvent application station 32 comprises a scrubbing assembly 34 which includes a cleaning belt 36 entrained about a series of rollers 38. One of rollers 38 is coupled to a motor (not shown) for powered rotation of belt 36. Rollers 38 and belt 36 are attached to a carriage 40 which is slidably mounted on a linear bearing slide assembly 42. Assembly 42 is affixed to a steel mounting base 44. An air cylinder 46 is used to shift carriage 40 on slide assembly 42. A perforated tube 4848 is used to apply solvent to belt 36 either by dripping or spraying. However, it is within the scope of the present invention for the solvent to be applied directly to container 24. Belt 36 can be made from a textile material, and in certain embodiments, comprises cotton or wool. Solvent application station 32 may also comprise a heat source 50, such as an infrared heat element or conduit for dispersing hot air. Although not required, it has been discovered that raising the temperature of the synthetic resin material assists with the ink removal process, particularly the ease and speed with which the ink is removed. Thus, heat source 50 may be used to raise the temperature of cup 24 as discussed previously.

Figure 4:
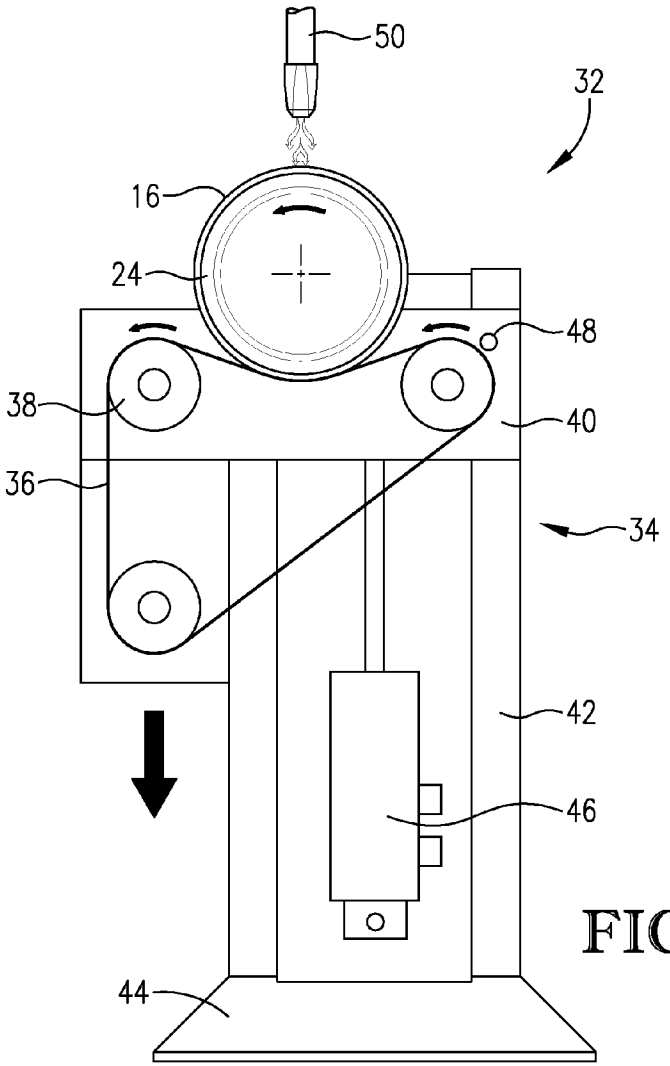
FIG. 4 is a diagram of the scrubbing station of FIG. 3 shown in contact with a container being de-inked.

As illustrated in FIG. 4, scrubbing assembly 34 is moved into engagement with cup 24. When hub 14 rotates a cup 24 to solvent application station 32 for de-inking, air cylinder 46 raises the carriage 40 placing belt 36 in contact with the spinning cup 24. Thus, solvent, which has been applied to belt 36 by tube 48, is applied onto cup 24 and belt 36 simultaneously scrubs ink from the cup. Periodically, belt 36 can be removed from carriage 40 for cleaning.

After cup 24 has been scrubbed, air cylinder 46 lowers carriage 40 back to the configuration shown in FIG. 3. Cup 24 is now ready to be advanced to the next station. In certain embodiments, cup 24 is advanced to a second solvent application station 52. This solvent application station is provided to ensure complete ink removal from the cups. However, it is understood that this additional station need not necessarily be included if a single solvent application station can adequately perform the de-inking operation. Solvent application station 52 can be configured similarly to solvent application station 32, although one of skill in the art can appreciate alternate belt configurations should spacing be an issue.

Figure 6:
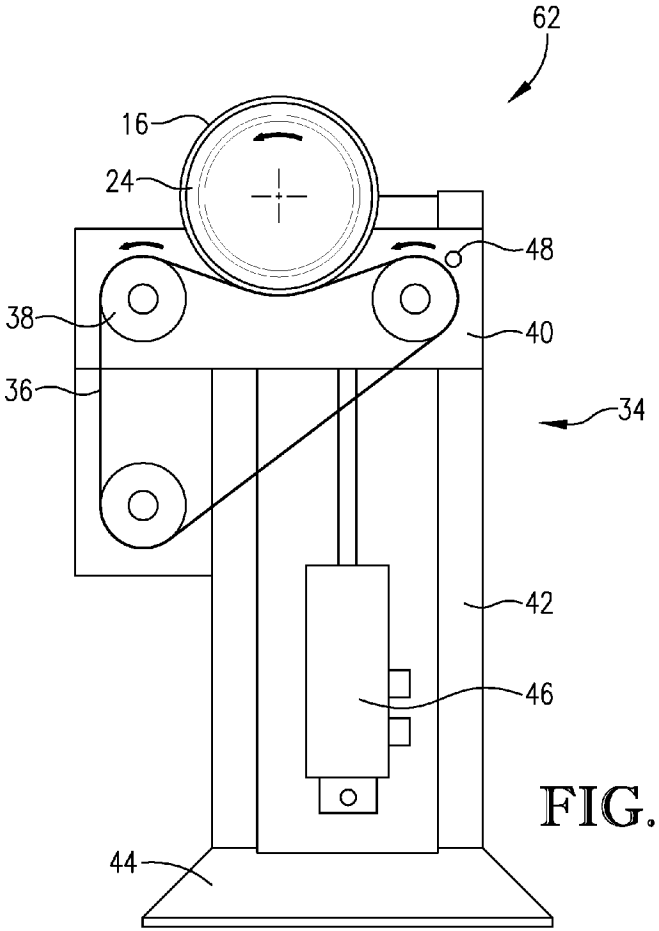
FIG. 6 is a diagram of another rinsing station for use with an apparatus according to the present invention.
Figure 5:
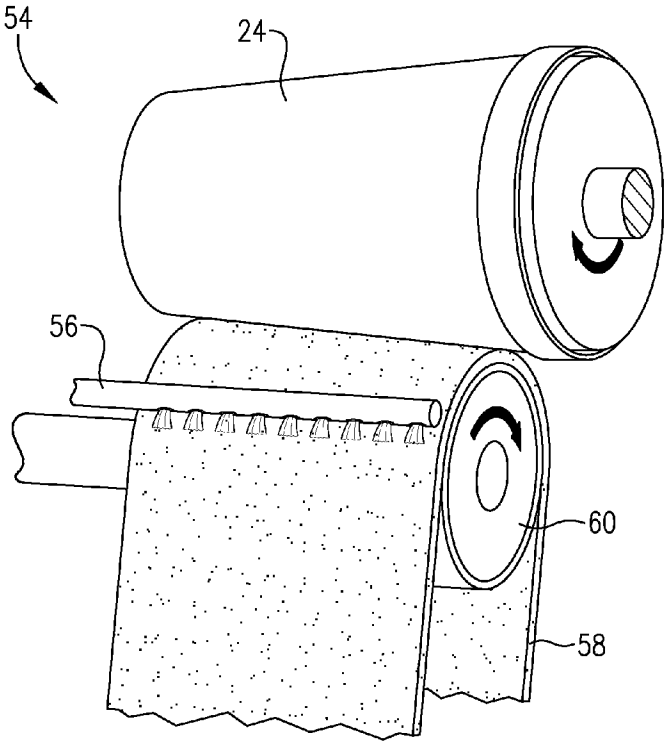
FIG. 5 is a diagram of a rinsing station for use with an apparatus according to the present invention.
Figure 7:
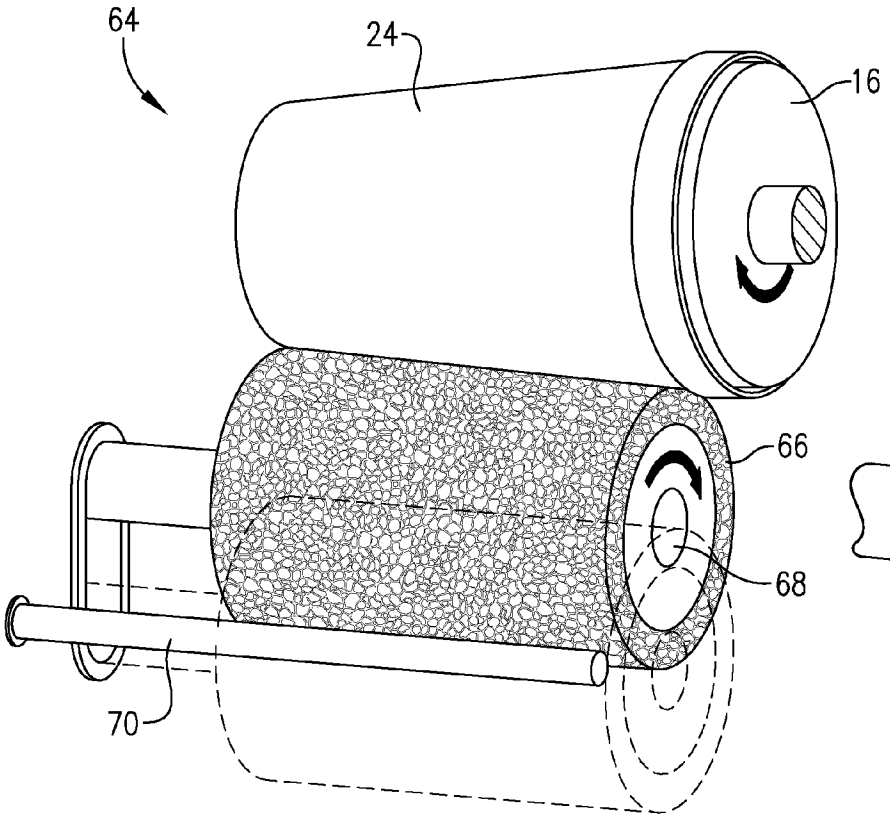
FIG. 7 is a diagram of a drying station for use with an apparatus according to the present invention.

Following solvent application station 52, hub 14 rotates so that cup 24 is delivered to a rinse station 54. Exemplary rinse stations are illustrated in FIGS. 5 and 6. Turning first to FIG. 5, water or other rinsing fluid is supplied by a perforated tube 56 and applied to a belt 58 entrained about two rollers 60, one of which is driven by a drive motor (not shown). Note, it is also within the scope of the present invention for the water to be directly applied to cup 24. Rollers 60 may shiftable so that belt 58 can be brought into and out of contact with cup 24. At rinse station 54, at least a portion of the solvent and solid ink residues on cup 24 are removed. The belt 58 can comprise any water absorbent material, and may be identical to belt 36 used in solvent application station 32. Alternatively, belt 58 can be replaced with a sponge material attached to a single roller 60. An example of such an assembly is shown in FIG. 7 and described further below.

Turning now to FIG. 6, an alternate rinse station 62 is illustrated. Rinse station 62 may be configured similarly to solvent application station 32, with the exception that heat source 50 is removed. Rinse station 62 is labeled with the same reference numerals as solvent application station 32 and operates in a similar manner except that a rinsing fluid, such as water, is dispensed from tube 48.

In operation, and as illustrated in FIG. 1, two rinse stations 54 and 62, for example, may be employed. Although, it is within the scope of the present invention for only one rinse station to be employed, or that a single rinse station configuration (54 or 62) be employed. However, dual rinse stations can help ensure complete removal of solvent and ink residues from cup 24 as the belt from a single rinse station can become saturated with solvent and ink particles thus reducing the rinsing efficacy.

After the solvent and ink residues are removed, hub 14 rotates so as to deliver cup 24 to a drying station 64. An exemplary drying station 64 is illustrated in FIG. 7. Drying station 64 comprises an absorbent material, such as a sponge 66, disposed on a shiftable roller 68. Sponge 66 can be cylindrical in shape or frustoconical so as to more readily mate with cup 24. After hub 14 rotates to deliver cup 24 to the drying station 64, roller 68 shifts upward into contact with cup 24 so that sponge 66 can absorb water present on the surface of the cup. After a sufficient contact time, roller 68 is shifted downwardly and sponge 66 is brought out of contact with cup 24, and hub 14 is again free to rotate cup 24 to the next station. Drying station 64 is also equipped with a bar 70 that comes into contact with sponge 66 when roller 68 is shifted downwardly. In this downward configuration, roller 68 continues rotation and sponge 66 impinges upon bar 70, which operates to squeeze water from the sponge. By removing water from sponge 66 in this manner, the sponge's absorptive capacity is maintained and water can be efficiently removed from the surface of cup 24.

Figure 8:
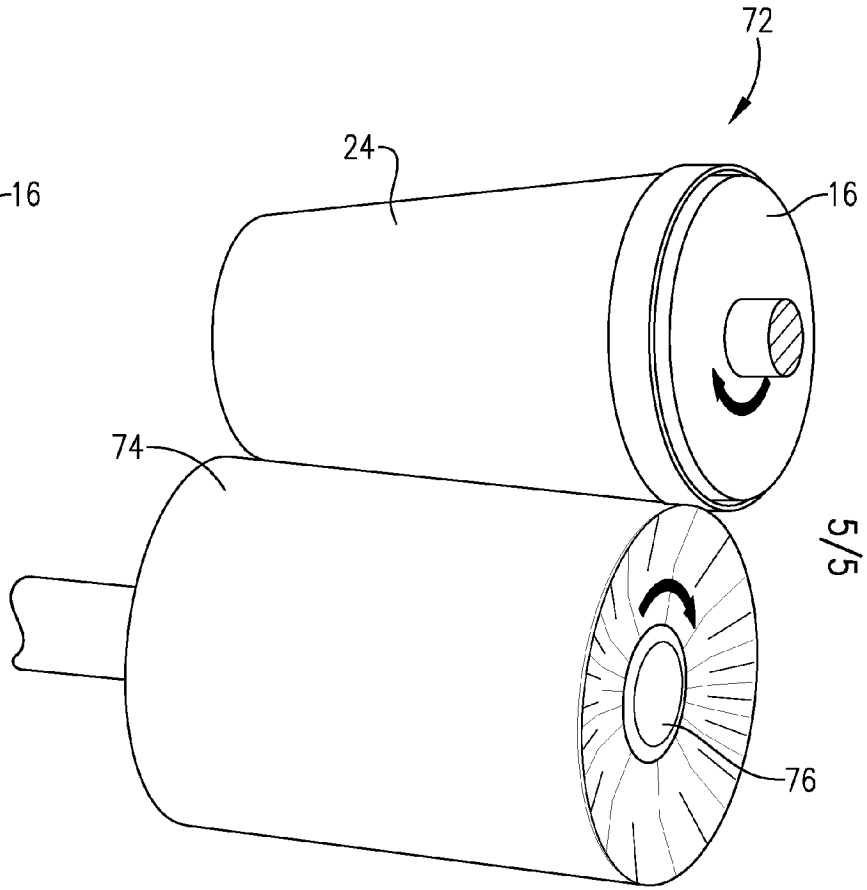
FIG. 8 is a diagram of a dry buffing station for use with an apparatus according to the present invention.

Next, hub 14 rotates so as to deliver cup 24 to a dry buff station 72, an exemplary configuration of which is depicted in FIG. 8. Dry buff station 728 comprises a buffing material 74 disposed on a roller 76. The buffing material generally comprises an absorptive material capable of removing any final water residues from the cup. In certain embodiments, the buffing material can be wool, cotton, or another textile material. As cup 24 enters dry buff station 72 and contacts buffing material 74, any residual moisture remaining on the cup 24 is absorbed by the buffing material 74. In certain embodiments, a heat source may supply heat to buffing material 74 and/or cup 24 to enhance final drying of the cup. In some embodiments, a UV light source (not shown) can be supplied as a part of station 72 so as to irradiate the de-inked surface of the cup 24 and kill germs or bacteria residing thereon.

After being buffed, hub 14 rotates yet again and delivers the de-inked cup 24 to an unloading station 78 where the cup 24 is removed from mandrel 16. A burst of positive pressure air from mandrel 16 can dislodge cujp 24 therefrom and place it into contact with a conveyor 80, such as a belt-type conveyor. Conveyor 80 forms a stack of de-inked cups 24 that are ready to be re-printed. In certain embodiments, cups 24 need not be stacked and can be directly fed to a printing press.

I claim:

1. A method for removing a printed ink image from an outer surface of a synthetic resin container comprising the steps of:
   a) providing said container with a cured ink image printed thereon, the ink image being printed onto said container with a UV-curable ink and cured through exposure of said ink to UV light;
   b) applying an organic solvent to a mechanical scrubbing device, said organic solvent being capable of solvating the ink image;
   c) heating the outer surface of said container to a temperature of between 100° to 185° F.;
   d) contacting the outer surface of said container with said solvent-containing mechanical scrubbing device while rotating said container thereby causing the image to separate therefrom, said contacting step including preventing contacting of an interior surface of said container with said solvent;
   e) rinsing solvent and ink residues from the outer surface of said container after said ink image is removed; and
   f) drying the outer surface of said container to create a de-inked container whose outer surface is capable of being immediately imprinted with a new ink image.

2. The method according to claim 1, wherein said heating step comprises heating the outer surface of said container to a temperature of between 130° to 170° F.

3. A method for removing a printed ink image from an outer surface of a synthetic resin container comprising the steps of:
   a) providing said container with a cured ink image printed thereon, the ink image being printed onto said container with a UV-curable ink and cured through exposure of said ink to UV light;
   b) applying an organic solvent to a mechanical scrubbing device, said organic solvent being capable of solvating the ink image, wherein said organic solvent comprises a surfactant;
   c) contacting the outer surface of said container with said solvent-containing mechanical scrubbing device while rotating said container thereby causing the image to separate therefrom, said contacting step including preventing contacting of an interior surface of said container with said solvent;
   d) rinsing solvent and ink residues from the outer surface of said container after said ink image is removed; and
   e) drying the outer surface of said container to create a de-inked container whose outer surface is capable of being immediately imprinted with a new ink image.

4. The method according to claim 3, wherein said surfactant comprises a C9-C11 alcohol alkoxylate.

5. A method for removing a printed ink image from an outer surface of a synthetic resin container comprising the steps of:
   a) providing said container with a cured ink image printed thereon, the ink image being printed onto said container with a UV-curable ink and cured through exposure of said ink to UV light;
   b) applying an organic solvent to a mechanical scrubbing device, said organic solvent being capable of solvating the ink image, wherein said organic solvent comprises a member selected from the group consisting of amyl propionate, butyl butyrate, alkyl lactates, ethyl hexyl acetate, dibasic esters, methyl soyate, ethyl soyate, cyclohexanone, methyl ethyl ketone, dipropylene glycol, dipropylene glycol methyl ether, trichloroethylene, ethanol, 2-propanol, tetrahydrofurfuryl alcohol, hexane, mineral spirits, monoethanolamine, d-limonene, dimethyl formamide, n-methyl pyrrolidone, propylene carbonate, and combinations thereof;
   c) contacting the outer surface of said container with said solvent-containing mechanical scrubbing device while rotating said container thereby causing the image to separate therefrom, said contacting step including preventing contacting of an interior surface of said container with said solvent;
   d) rinsing solvent and ink residues from the outer surface of said container after said ink image is removed; and
   e) drying the outer surface of said container to create a de-inked container whose outer surface is capable of being immediately imprinted with a new ink image.

6. The method according to claim 1, wherein said rinsing in step d) comprises applying water to another mechanical scrubbing device and contacting said container with said water-containing mechanically scrubbing device.

7. The method according to claim 1, wherein said synthetic resin material comprises containers formed from polyethylene or polypropylene.

8. A method for removing a printed ink image from an outer surface of a synthetic resin container comprising the steps of:
   a) providing said container with a cured ink image printed thereon, the ink image being printed onto said container with a UV-curable ink and cured through exposure of said ink to UV light;
   b) applying an organic solvent to a mechanical scrubbing device, said organic solvent being capable of solvating the ink image;

c) contacting the outer surface of said container with said solvent-containing mechanical scrubbing device while rotating said container thereby causing the image to separate therefrom, said contacting step including preventing contacting of an interior surface of said container with said solvent;

d) rinsing solvent and ink residues from the outer surface of said container after said ink image is removed; and e) drying the outer surface of said container to create a de-inked container whose outer surface is capable of being immediately imprinted with a new ink image.

* * * * *